United States Patent [19]

Masters

[11] Patent Number: 4,727,821

[45] Date of Patent: Mar. 1, 1988

[54] DETACHABLE POD AND KAYAK

[76] Inventor: William E. Masters, P.O. Box 686, Liberty, S.C. 29657

[21] Appl. No.: 912,610

[22] Filed: Sep. 29, 1986

[51] Int. Cl.[4] ..... B63B 35/71

[52] U.S. Cl. ..... 114/347; 114/352; 441/126

[58] Field of Search ..... 114/347, 351, 352, 357, 114/248, 324, 325; 441/126, 127

[56] References Cited

U.S. PATENT DOCUMENTS

| | | | |
|---|---|---|---|
| 3,634,897 | 1/1972 | Cuccio | 114/248 |
| 3,822,427 | 7/1974 | Ewart | 114/352 |
| 4,031,580 | 6/1977 | Neumann et al. | 114/347 |
| 4,583,480 | 4/1986 | Hamilton et al. | 114/361 |

FOREIGN PATENT DOCUMENTS

| | | | |
|---|---|---|---|
| 581186 | 11/1924 | France | 114/324 |
| 2030078 | 4/1980 | United Kingdom | 114/347 |

*Primary Examiner*—Sherman D. Basinger
*Assistant Examiner*—Thomas J. Brahan
*Attorney, Agent, or Firm*—Cort Flint

[57] ABSTRACT

A kayak (10) is an elongated hull (12) having a hull interior (20) and an upper hull portion in which a cockpit (18) is formed for accommodating a boater in a seated position. A perimeter hull flange (22) is formed in the upper hull portion of the kayak defining a deck opening (24). A detachable pod deck (26) is carried in the deck opening. A cockpit rim (30) is formed in the pod deck defining a cockpit opening (32). A pod compartment (27) is carried in the hull interior below the pod deck generally closed and isolated from the hull interior. A cockpit seat (34) is carried in the pod compartment in which a boater may be seated. Attachment for attaching and sealing the pod deck and the upper hull portion together in an integral manner during normal kayak operation includes a retaining band (54, 94) and a sealing ring (60) sealing between hull and said pod deck against the entry of water. The attachment is releasable to allow said pod deck to be detached in an emergency to facilitate removal of said pod deck and compartment.

35 Claims, 8 Drawing Figures

Fig. 3.
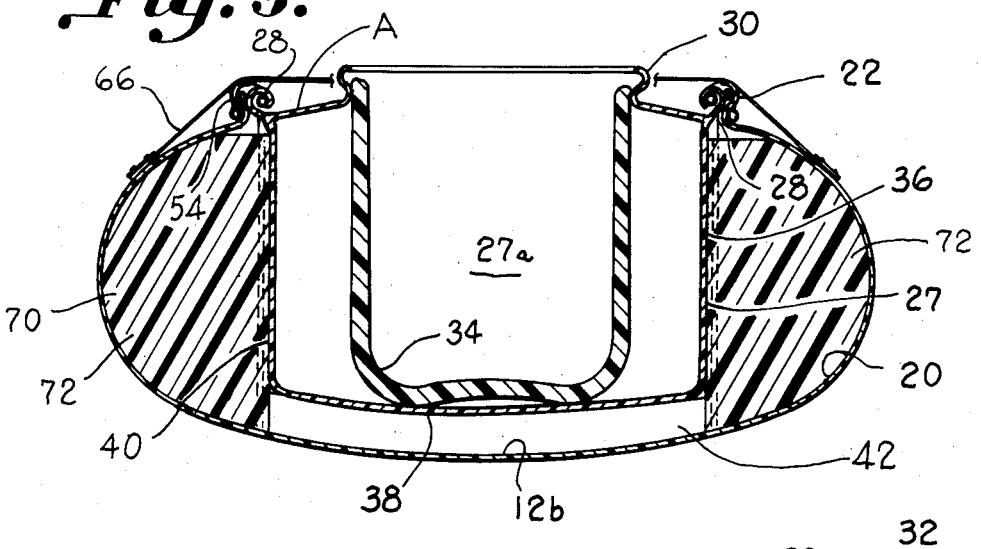
Fig. 4.
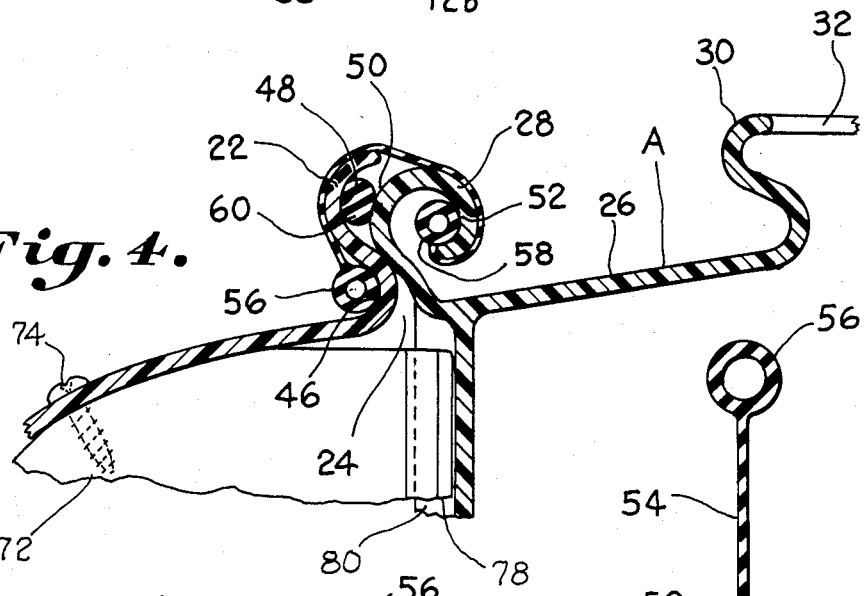
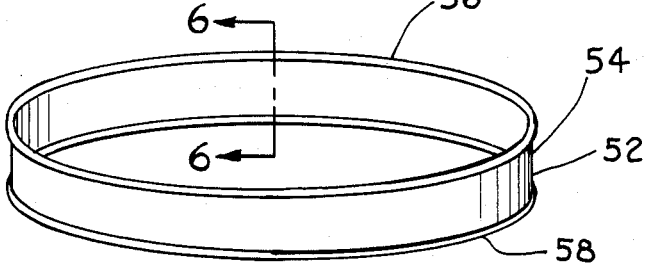
Fig. 5.
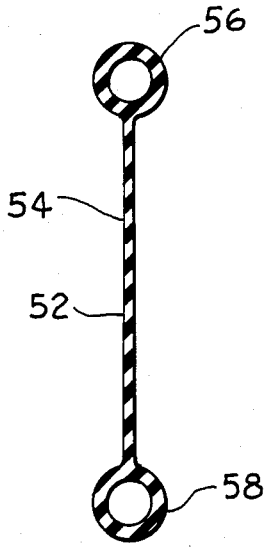
Fig. 6.

Fig. 7.
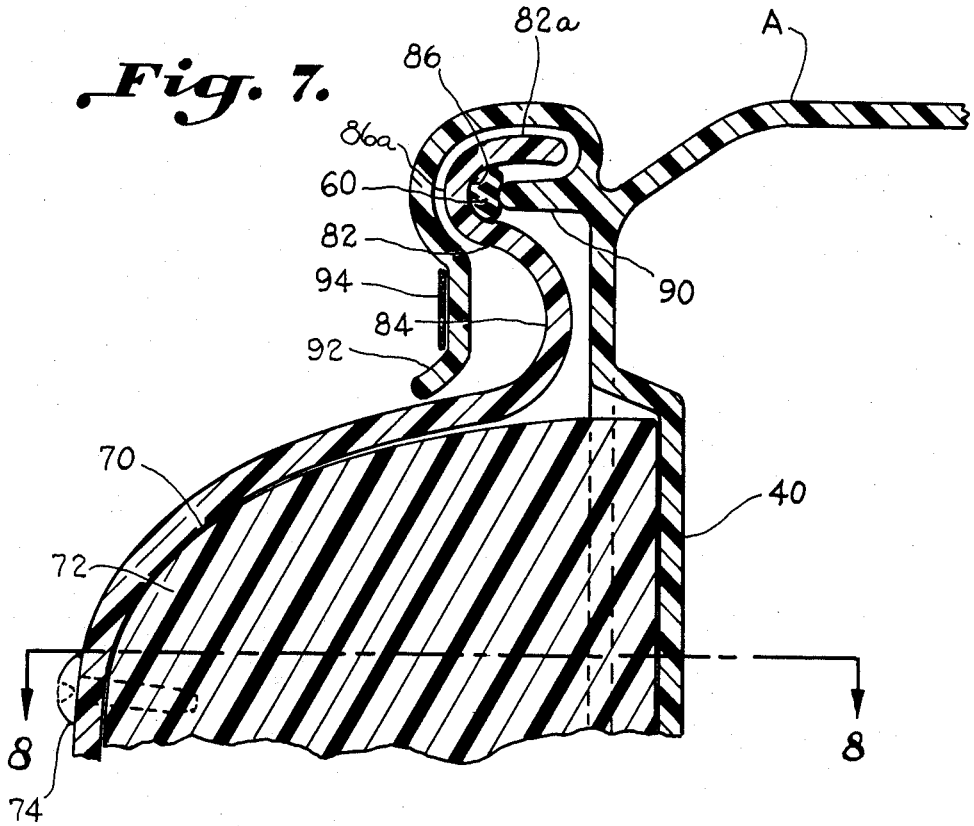
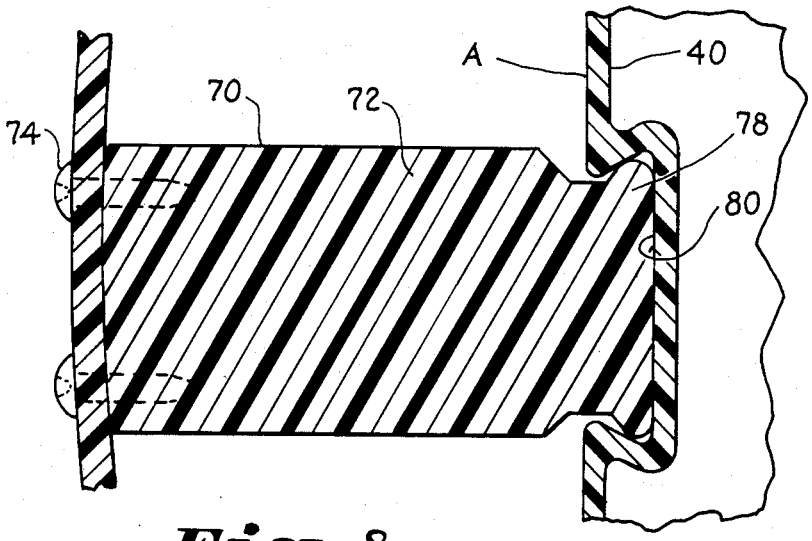
Fig. 8.

DETACHABLE POD AND KAYAK

BACKGROUND OF THE INVENTION

This invention relates to a kayak type boat and the like wherein the boater may be seated in a watertight pod which may be detached from the kayak to permit escape under adverse conditions.

Heretofore, kayaks have been proposed with certain portions of the hull which may be broken away such as disclosed in U.S. Pat. No. 4,583,480 which discloses a break away cockpit wherein a portion of the forward section of the hull and cockpit rim may be broken away to permit escape of the boater under adverse conditions.

United Kingdom Patent Application No. GB 211,915 discloses a canoe of the kayak type having a longitudinal strengthener alongside which the canoeist sits. A rip away deck panel is provided forward of the cockpit section so that the legs of the canoeist are not trapped about the strengthener, or should the canoeist slip into the foresection of the canoe during adverse conditions (e.g. fast water running abeam in a canoe trapped against a rock).

Although the above features may be suitable in a number of situations, it is also desirable that the boater be protected after escape from a kayak or canoe.

It has also been known to fasten a bag about the rim of a cockpit and invert the bag inside the interior of the hull. Bags constructed from a fiberglass material have been connected about the rim of a cockpit and inverted inside the hull interior to provide a watertight pouch in which a boater may be accommodated. The hull interior does not fill up with water when the kayak is swamped.

Accordingly, an object of the present invention is to provide a kayak from which escape may be had in a well protected manner.

Another object of the invention is to provide a kayak in which the boater may be seated in a protective pod unit which may be detached from the kayak to permit escape from the hull under adverse conditions.

Another object of the invention is to provide a kayak having a detachable pod unit which is tailored to fit the needs of an individual boater and may be interchanged among different kayak hulls.

Still another object of the invention is to provide a pod unit for a kayak which is watertight and isolates the boater from the hull interior to prevent swamping of the kayak and which pod unit may be buoyant to maintain the boater afloat after detachment from the kayak when trapped.

Still another object of the invention is to provide an interchangable pod unit having a pod deck and compartment customized for a specific person's body fit including his hips, knees, and feet which may be interchanged among different kayak hulls.

SUMMARY OF THE INVENTION

The above objectives are accomplished according to the invention in a kayak having an elongated hull with a fore and aft section and a hull interior wherein a hull flange is carried about a perimeter of an upper portion of the hull defining a deck opening. A detachable pod unit is carried by the hull which includes a pod deck carried in the deck opening and a pod compartment carried below the pod deck within the hull interior. A pod deck rim is carried by the pod deck mating with the hull flange in a manner that the hull and the pod unit may be connected together. A cockpit opening is formed in the pod deck adapted for accommodating a boater in a seated position within the pod compartment. The hull flange and pod deck rim are secured together in a releasable and waterproof manner so that the pod unit may be detached from the hull to permit detachment and escape from the hull.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 3 is a sectional view taken along line 3—3 of FIG. 1;

FIG. 4 is a section view illustrating the releasable attachment of a detachable pod unit and kayak hull constructed in accordance with the present invention;

FIG. 5 is an elevation of a retaining band for retaining a detachable pod unit and kayak hull together in accordance with the invention; and FIG. 6 is a sectional view taken along line 6—6 of FIG. 5.

FIG. 7 is a section view of of an alternate embodiment of the releasable attachment of the detachable pod unit and kayak hull;

FIG. 8 is a sectional view taken along line 8—8 of FIG. 7.

DESCRIPTION OF A PREFERRED EMBODIMENT

Figure 1:
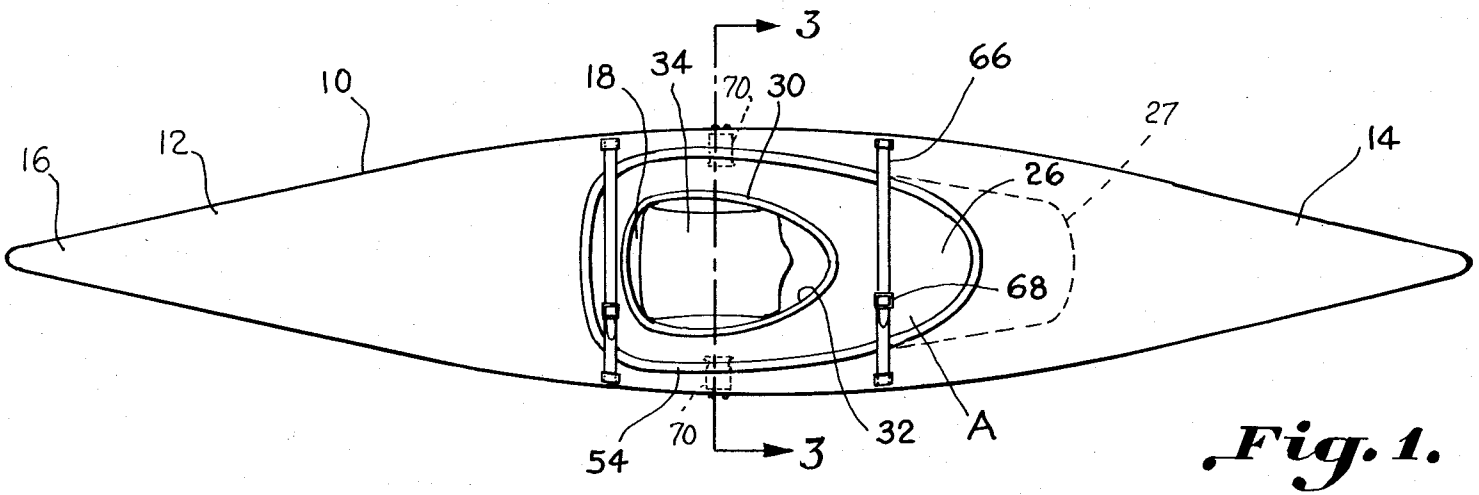
FIG. 1 is a top plan view of a kayak having a detachable pod unit constructed in accordance with the present invention.

Referring now in more detail to the drawings, a kayak is illustrated at 10 having, a hull 12 formed of a suitable material such as a flexible skin material disclosed in U.S. Pat. No. 4,227,272 identified therein as a crosslink polyethylene material such as Marlex brand polyethylene manufactured by Phillips Chemical Company. The hull is typically made by molding in a conventional rotational molding machine or may be made by vacuum molding to provide a continuously enclosed hull having a fore section 14 and an aft section 16, cockpit 18, and a hull interior 20.

A hull flange 22 is formed in an upper portion of hull 12 to define a deck opening 24. Deck opening 24 is much larger than the conventional cockpit opening found in most kayak structures. A detachable pod unit A is illustrated which includes a pod deck 26 and a pod compartment 27. The pod deck 26 includes a pod deck rim 28 which mates with hull flange 22 as can best be seen in FIGS. 3 and 4. A cockpit rim 30 formed in pod deck 26 defines a cockpit opening 32 through which a boater may have access to a cockpit seat 34 carried in pod unit A.

Pod unit A may be rotationally molded from a crosslink polymeric material such as the Marlex brand polyethylene material described from which hull 12 is made of and is sufficiently rigid to be of a self-supporting form.

Figure 2:
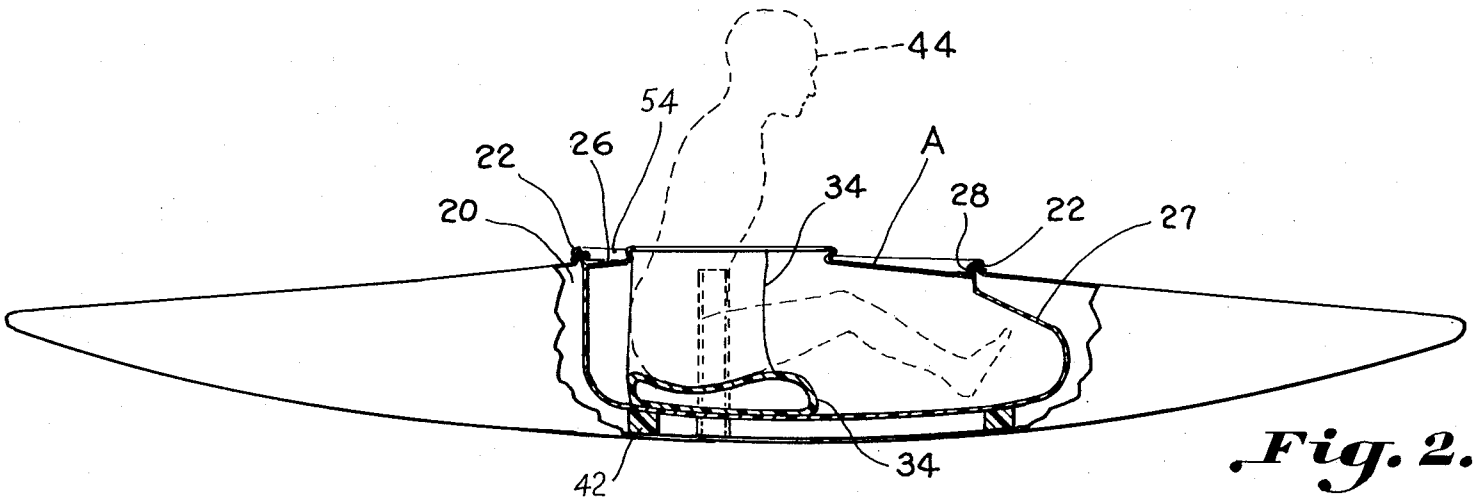
FIG. 2 is an elevation with parts cut away and in section illustrating a detachable pod unit for a kayak constructed in accordance with the present invention.

Referring in more detail to the construction of pod unit A, it can be seen in FIGS. 2 and 3 that the pod unit comprises a side wall 36, bottom wall 38, and opposing side wall 40. The interior of the pod compartment 27 may be customized to a particular boater's size, fitting of his hips, thighs, and feet for bracing. In this manner, the individualized and customized pad unit may be interchangably placed in different kayaks. Pod support means 42 are included between the bottom 38 of compartment 27 and a bottom surface 12*b* of hull 12. Referring further to FIGS. 2 and 3, it can be seen that the interior 27*a* of pod compartment 27 is isolated from the remainder of the interior of the kayak hull and encloses boater 44.

Hull flange 22 has a generally S-shaped form which includes a first outwardly curved surface 46 and a second inwardly curved surface 48. Pod deck rim 28 includes a nesting surface 50 which is correspondingly curved to the contour of inwardly curved surface 48 for mating of the flange and rim. Cockpit rim 28 terminates in a retaining lip 52, the purpose of which will be described in more detail hereinafter.

Attachment means for sealing, attaching, and interlocking together detachable pod unit A and hull 12 includes an elastic retaining band 54 which includes an elastic web 52 which joins a pair of bulbous retaining elements 56 and 58. Bulbous retaining elements 56 and 58 may be hollow and compressible as illustrated or may include elastic elements such as an elastic cord. There is a compressible sealing ring 60 compressed between hull flange surface 22 and nesting surface 50 of pod deck rim 28. Sealing ring 60 provides means for sealing and assuring that water does not enter into the hull interior. With sealing ring 60 in place, retaining means in the form of elastic retaining band 54 may be fitted about flange 12 and rim 28 about the entire perimeter thereof. In its retaining position, retaining band 54 has first retaining element 56 retained by outwardly curved surface 46 of hull flange 22. Second retaining element 58 of retaining band 54 is retained by retaining lip 52 of pod rim 28.

In this manner, pod unit A is detachably and releasably connected and attached to hull 12. Either under impact force, or force encountered by the kayak being trapped against water, or by force of the boater, pod unit A may be released. It will be noted that with retaining band 54 and sealing ring 60 inserted and attached in place, a generally waterproof seal will be provided to prevent the entry of water into the interior 20 of hull 12. In this manner swamping of the kayak is prevented should the kayak be trapped in a position where oncoming water is forced against or into the kayak. Further, with a conventional spray skirt fastened about cockpit rim 30 and the waist of the boater, when pod unit A is detached and separated from the hull, interior 27*a* of pod unit A will be virtually waterproof and the cockpit unit will be buoyant so that the boater is maintained afloat once the unit is detached.

Attachment means further includes a lock means formed of a strap 66 which is strapped across the hull 12 and pod deck 26 of pod unit A. A snap type toggle release connector 68 may be provided for quickly releasing the straps in case of an emergency so that pod unit A may be released and detached. Locking straps 26 may not be necessary under all conditions, but may be under some.

As can best be seen in FIGS. 3 and 8, brace means 70 braces opposing sides of pod unit A laterally between hull 12. Brace means 70 may include rigid cellular foam blocks 72 attached to the sides of hull 12 by conventional fasteners 74. An interlocking joint 76 is provided between brace blocks 72 and pod compartment 27 in the form of a dovetail edge 78 along the vertical edge of brace blocks 72 and a dovetail groove 80 formed vertically in walls 40 and 36 of the pod compartment. In this manner, pod compartment 27 may slide into the hull interior vertically over dovetail edges 78 and may likewise slide out of the hull for detachment during an emergency.

FIG. 7 illustrates an alternate arrangement for attachment means for attaching pod unit A and kayak hull 12 together integrally. There is a generally S-shaped hull flange 82 having an outwardly curved surface 84 and an inwardly curved surface 86. Top flange 82*a* of flange 82 will flex to allow pod unit A to be inserted under the flange. There is a pod deck rim 88 having a nesting surface in the form of a flange 90 bearing against sealing ring 60 forcing same against curved surface 86. Flange 82 and pod rim 88 are semi-rigid polyethylene. Rim 88 includes a curved downwardly depending leg 92 covering flange 82 assisting in a waterproof seal and joint. Leg 92 is flexible and may flex inwardly into interlocking engagement with hull flange surface 84 and bond surface 86*a* under force of a releasable belt means 94. Belt means 94 may be any suitable belting, strapping, or elastic band and provides a retaining means similar to band 54. Preferably belt means 94 is a belt or strap (webbing or stainless steel) with a quick release buckle such that the belt may be tightened while buckled but released quickly, i.e. a seat belt and buckle.

Thus it can be seen that an advantageous construction can be had for a detachable pod unit. Retaining band 54, or leg 92 at belt 94 and sealing ring 60 keep the pod unit and hull attached together in a waterproof manner. With straps 60 unlocked, elastic retaining band 54, 94 may be rolled or snapped off of flange 22 and rim 28, manually or under force, to allow pod unit A to detach from kayak 10. The pod unit may be quickly released under impact forces or manually by the boater. The attachment and sealing arrangement between the hull and pod unit keeps water from entering the hull interior preventing the kayak from becoming swamped should the kayak become trapped against the water flow. Pod unit A may be customized to fit a particular boater and interchanged between kayak hulls. Further, should the pod unit A become detached with a boater seated, the pod unit is buoyant and maintains the boater afloat. If the boater has a spray skirt on, water is prevented from entering the interior of the pod unit so that a highly buoyant and floating unit is provided.

Should the kayak undergo high impact forces or become trapped and under extreme forces from water pressure, pod unit A may release and pop out of the kayak hull.

While a preferred embodiment of the invention has been described using specific terms, such description is for illustrative purposes only, and it is to be understood that changes and variations may be made without departing from the spirit or scope of the following claims.

What is claimed is:

1. A kayak comprising:

an elongated hull having a fore and aft section and a hull interior;

a hull flange carried about a perimeter of an upper portion of said hull defining a deck opening;

a detachable pod unit carried by said hull including a pod deck carried in said deck opening and a pod compartment carried below said pod deck within said hull interior;

a pod deck rim carried by said pod deck mating with said hull flange in a manner that said hull and said pod unit may be releasably interconnected together;

a cockpit opening formed in said pod deck adapted for accommodating a boater in a seated position within said pod unit; and attachment means securing said hull flange and pod deck rim together in a releasable manner so that said pod unit may be detached and separated from said hull to permit emergency egress from said kayak.

2. The kayak of claim 1 wherein said attachment means includes retaining means interconnecting said hull flange and said pod deck rim.

3. The kayak of claim 2 including sealing means carried between said hull flange and said pod deck rim to seal the periphery of said deck opening against the entry of water, and said retaining means interconnecting said hull flange and said pod deck rim with said sealing means carried therebetween.

4. The kayak of claim 2 wherein said retaining means comprises an elastic retaining band.

5. The kayak of claim 4 wherein said elastic band comprises a pair of retaining elements and an elastic web extending between said retaining elements which may be fitted over said hull flange and said pod deck rim to provide a smooth rim covering with a first retaining element being retained about said hull flange and a second retaining element being retained by said pod deck rim.

6. The kayak of claim 5 wherein said retaining elements include elastic bulbous retaining elements.

7. The kayak of claim 2 wherein said retaining means includes a releasable belt means.

8. The kayak of claim 1 wherein said hull flange includes a generally S-shaped flange having a first outwardly curved surface and a second inwardly curved surface.

9. The kayak of claim 8 wherein said pod deck rim includes a nesting surface mating and nesting with said second inwardly curved surface of said hull flange.

10. The kayak of claim 9 wherein said pod deck rim further includes a retaining lip about which said attachment means is fastened.

11. The kayak of claim 10 wherein said attachment means includes a retaining band having a first retaining element and a second retaining element, said first retaining element being retained by said first outwardly curved surface of said hull flange and said second retaining element being retained in said retaining lip of said pod deck rim.

12. The kayak of claim 11 wherein said retaining band comprises an elastic web extending between said first and second retaining elements wherein said first and second retaining elements include elastic bulbous retaining elements.

13. The kayak of claim 9 including a sealing means carried between said second inwardly curved hull flange surface and said nesting surface of said pod deck rim for sealing between said hull flange and pod deck rim and providing a compressible abutment by which said hull flange and pod deck rim may be pulled tightly together by said retaining band.

14. The kayak of claim 1 including pod support means carried between said pod compartment and a bottom floor of said hull interior supporting said pod compartment above the same.

15. The kayak of claim 1 wherein said attachment means includes quickly releasable lock means which secures and maintains said pod deck in a flush relationship with said upper portion of said hull and must be released before said pod deck and said hull may be separated.

16. The kayak of claim 1 wherein said rim includes a flexible depending leg received over said hull flange, and said attaching means further includes a releasable belt means urging said flexible depending leg in an interlocking relation with said hull flange.

17. The kayak of claim 1 including brace means affixed between said kayak hull and said pod compartment for bracing said pod compartment laterally.

18. The kayak of claim 17 wherein said brace means includes a brace block having a vertical dovetail edge, and a groove formed in said pod compartment wall slidably receiving said dovetail edge in an interlocking manner.

19. The kayak of claim 17 including an interlocking joint formed between said brace means and pod which permits sliding relative movement in a vertical direction therebetween for detachment.

20. A kayak comprising:

an elongated hull having a hull interior and an upper hull portion in which a cockpit is formed for accommodating a boater in a seated position;

a perimeter hull flange formed in said upper hull portion of said kayak defining a deck opening;

a detachable pod deck carried in said deck opening;

a cockpit rim formed in said pod deck defining a cockpit opening;

a pod compartment carried in said hull interior below said pod deck generally closed and isolated from said hull interior;

a cockpit seat carried in said pod compartment in which a boater may be seated in said pod compartment;

attachment means for attaching said pod deck and said upper hull portion together in an integral manner during normal kayak operation and sealing between hull and said pod deck against the entry of water; and said attachment means being releasable to allow said pod deck to be detached and separated from said hull in an emergency to facilitate removal of said pod deck and compartment.

21. The kayak of claim 20 wherein said attachment means includes a pod deck rim formed about the perimeter of said pod deck; said hull flange and pod deck rim mating together; and retaining means retaining said hull flange and pod deck in an interconnected waterproof manner.

22. The kayak of claim 21 wherein said pod deck and said pod compartment form an integral pod unit which is detachable from said kayak hull to provide emergency egress of said pod unit with said boater seated therein.

23. The kayak of claim 22 wherein said pod compartment has a self-supporting form and forms a buoyant compartment together with said pod deck in which said boater may float when detached and separated from said kayak hull.

24. The kayak of claim 20 wherein said attachment means comprises a lock strap extending across said upper hull portion and said pod deck having a releasable connector which must be released prior to said pod deck being detached from said hull.

25. The kayak of claim 20 wherein said rim includes a flexible depending leg received over said hull flange, and said attaching means further includes a releasable belt means urging said flexible depending leg in an interlocking relation with said hull flange.

26. The kayak of claim 20 including brace means affixed between said kayak hull and said pod compartment for bracing said pod compartment laterally.

27. A kayak comprising:

an elongated kayak hull having an upper hull portion;

a detachable and removable pod deck carried by said upper hull portion of said kayak;

a kayak cockpit formed in said removable pod deck;

attachment means securing and retaining said removable pod deck and said upper hull portion together in an integral manner during normal kayak operations;

a self supporting pod carried within said hull below said removable pod deck having a self-supporting form for enclosing a boater seated in said cockpit isolating said boater from interior of said hull;

a cockpit seat carried in said pod for seating said boater; and said detachable pod deck and said pod being removable from said kayak hull for emergency escape from said kayak.

28. A kayak of claim 27 wherein said detachable pod deck and pod are buoyant for maintaining said boater in a floating condition in water during an escape.

29. A kayak of claim 28 wherein said pod deck and pod are formed as a one piece unit.

30. The kayak of claim 29 including pod support means for supporting said pod above a bottom floor of said hull interior.

31. The kayak of claim 27 wherein said attachment means comprises a flange carried by said hull, a rim carried about a perimeter of said pod deck, and means attaching said flange and rim together in a releasable and waterproof manner.

32. The kayak of claim 31 wherein said attachment means includes an elastic retaining band fitted over said hull flange and said pod deck rim to releasably attach the same together and cover said flange and rim to present a smooth, pleasing closure rim.

33. The kayak of claim 31 wherein said rim includes a flexible depending leg received over said hull flange, and said attaching means further includes a releasable belt means urging said flexible depending leg in an interlocking relation with said hull flange.

34. The kayak of claim 33 wherein said hull flange includes an outwardly curved surface into which said flexible depending leg is urged by said belt means to provide said interlocking relation.

35. The kayak of claim 27 including brace means affixed between said kayak hull and said pod for bracing said pod laterally.

* * * * *